US010047592B2

(12) United States Patent
Burgos et al.

(10) Patent No.: US 10,047,592 B2
(45) Date of Patent: Aug. 14, 2018

(54) SYSTEM AND METHOD FOR PERFORMING A PERFORATION OPERATION

(71) Applicant: Schlumberger Technology Corporation, Sugar Land, TX (US)

(72) Inventors: Rex Burgos, Richmond, TX (US); Douglas Pipchuk, Calgary (CA); Rod Shampine, Houston, TX (US); Victor M. Bolze, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 734 days.

(21) Appl. No.: 14/402,081

(22) PCT Filed: May 15, 2013

(86) PCT No.: PCT/US2013/041052
§ 371 (c)(1),
(2) Date: Nov. 18, 2014

(87) PCT Pub. No.: WO2013/173404
PCT Pub. Date: Nov. 21, 2013

(65) Prior Publication Data

US 2015/0096752 A1 Apr. 9, 2015

Related U.S. Application Data

(60) Provisional application No. 61/648,866, filed on May 18, 2012.

(51) Int. Cl.

| | |
|---|---|
| ***E21B 43/1185*** | (2006.01) |
| *E21B 47/12* | (2012.01) |
| *E21B 17/20* | (2006.01) |

(52) U.S. Cl.
CPC .... *E21B 43/11857* (2013.01); *E21B 43/1185* (2013.01); *E21B 17/206* (2013.01); *E21B 47/12* (2013.01); *E21B 47/123* (2013.01)

(58) Field of Classification Search
CPC ..... E21B 43/11857; E21B 43/1185
See application file for complete search history.

(56) References Cited

U.S. PATENT DOCUMENTS 4,971,160 A 11/1990 Upchurch
5,287,924 A 2/1994 Burleson et al.
(Continued)

FOREIGN PATENT DOCUMENTS

RU 2004134191 A 5/2006
RU 2278956 C1 6/2006
(Continued)

OTHER PUBLICATIONS

"Selective Coiled Tubing Conveyed Perforating in Horizontal Wells", 2012, 5 pages.
(Continued)

*Primary Examiner* — Giovanna C. Wright
*Assistant Examiner* — Kristyn A Hall
(74) *Attorney, Agent, or Firm* — Michael L. Flynn; Robin Nava

(57) ABSTRACT

A technique facilitates performance of a perforating operation in a wellbore. The technique comprises positioning a perforating gun assembly downhole in a wellbore via coiled tubing. The perforating gun assembly has a plurality of individually controllable perforating gun sections which may be selectively fired at different well zones. An optical fiber is deployed along the coiled tubing to deliver control signals to the perforating gun assembly. The control signals
(Continued)

enable sequential firing of the individually controllable perforating gun sections at the desired locations, e.g. well zones, along the wellbore.

20 Claims, 4 Drawing Sheets

(56) References Cited

U.S. PATENT DOCUMENTS

| | | | | |
|---|---|---|---|---|
| 5,505,261 | A | 4/1996 | Huber et al. | |
| 5,890,539 | A | 4/1999 | Huber et al. | |
| 6,283,227 | B1 | 9/2001 | Lerche et al. | |
| 7,617,873 | B2 | 11/2009 | Lovell et al. | |
| 2001/0050172 | A1* | 12/2001 | Tolman | E21B 17/203 166/297 |
| 2005/0150687 | A1 | 7/2005 | Vicente et al. | |
| 2005/0263281 | A1 | 12/2005 | Lovell et al. | |
| 2006/0196665 | A1 | 9/2006 | LaGrange et al. | |
| 2010/0000789 | A1 | 1/2010 | Barton et al. | |
| 2010/0230105 | A1* | 9/2010 | Vaynshteyn | E21B 43/11857 166/297 |
| 2011/0024116 | A1 | 2/2011 | McCann et al. | |
| 2013/0080063 | A1* | 3/2013 | Pillai | E21B 47/18 702/9 |

FOREIGN PATENT DOCUMENTS

| | | | |
|---|---|---|---|
| WO | 2004020790 | A1 | 3/2004 |
| WO | 2008081404 | A1 | 7/2008 |
| WO | 2011154683 | A2 | 12/2011 |
| WO | 2013173404 | A1 | 11/2013 |

OTHER PUBLICATIONS

Schlumberger, "CoilFIRE Select", poster, 2012, 1 page.
European Search Report issued in European Patent Application No. 13791116.0 dated Feb. 15, 2016; 4 pages.
Examination Report issued in European Patent Application No. 13791116.0 dated Mar. 29, 2016; 6 pages.
Office Action issued in European Patent Application No. 13791116.0 dated Feb. 22, 2017; 4 pages.
International Search Report and the Written Opinion for International Application No. PCT/US2013/041052 dated Sep. 26, 2013.
Examination Report issued in GCC Patent Application No. GC 2013-24422 dated Nov. 15, 2016; 4 pages.

* cited by examiner

SYSTEM AND METHOD FOR PERFORMING A PERFORATION OPERATION

BACKGROUND

In many well applications, perforation operations are performed to create perforations which extend into the surrounding formation. Perforating guns are deployed downhole and carry charges which are detonated and fired to create radially extending perforations. Coiled tubing is sometimes employed in perforating operations to push gun strings down highly deviated wellbores, e.g. horizontal and extended reach wellbores. Additionally, a telemetry system is employed to carry control signals to the gun string for initiation of detonation and creation of the perforations at a desired well zone.

SUMMARY

In general, a system and methodology are provided for performing a perforating operation in a wellbore with a lighter and more dependable coiled tubing system. The technique comprises positioning a perforating gun assembly downhole in a wellbore via coiled tubing. The perforating gun assembly has a plurality of individually controllable perforating gun sections which may be selectively fired at different well zones. An optical fiber is deployed along the coiled tubing to deliver control signals to the perforating gun assembly while limiting the weight of the overall system. The control signals enable sequential firing of the individually controllable perforating gun sections at the desired locations, e.g. well zones, along the wellbore.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for performing perforating operations along a wellbore. According to an embodiment, coiled tubing is employed to position a perforating gun assembly downhole in a wellbore at a desired, initial zone to be perforated. The perforating gun assembly has a plurality of individually controllable perforating gun sections which may be selectively fired at different well zones. A surface control system may be used to supply signals downhole, and those control signals are then processed downhole to selectively fire the individual perforating gun sections. The selective control over individual gun sections enables sequential perforation of desired well zones, including non-contiguous well zones. In this embodiment, an optical fiber is deployed along the coiled tubing to reduce weight and to deliver the control signals to the perforating gun assembly.

The system and methodology may be designed to provide a multi-fire perforation system which minimizes the number of trips into the well while perforating well zones, such as non-contiguous well zones. The system and methodology also provide a repeatable, reliable approach to initiating gun detonation in a manner which is impervious to the changing wellbore environment. According to an embodiment, the system utilizes addressable switch technology and is processor controlled, e.g. microprocessor controlled, in response to control signals originating from equipment located at the surface. Communication and telemetry may be established through the optical fiber, e.g. a fiber optic tether, installed along the coiled tubing, e.g. within a fluid flow path of the coiled tubing.

Figure 1:
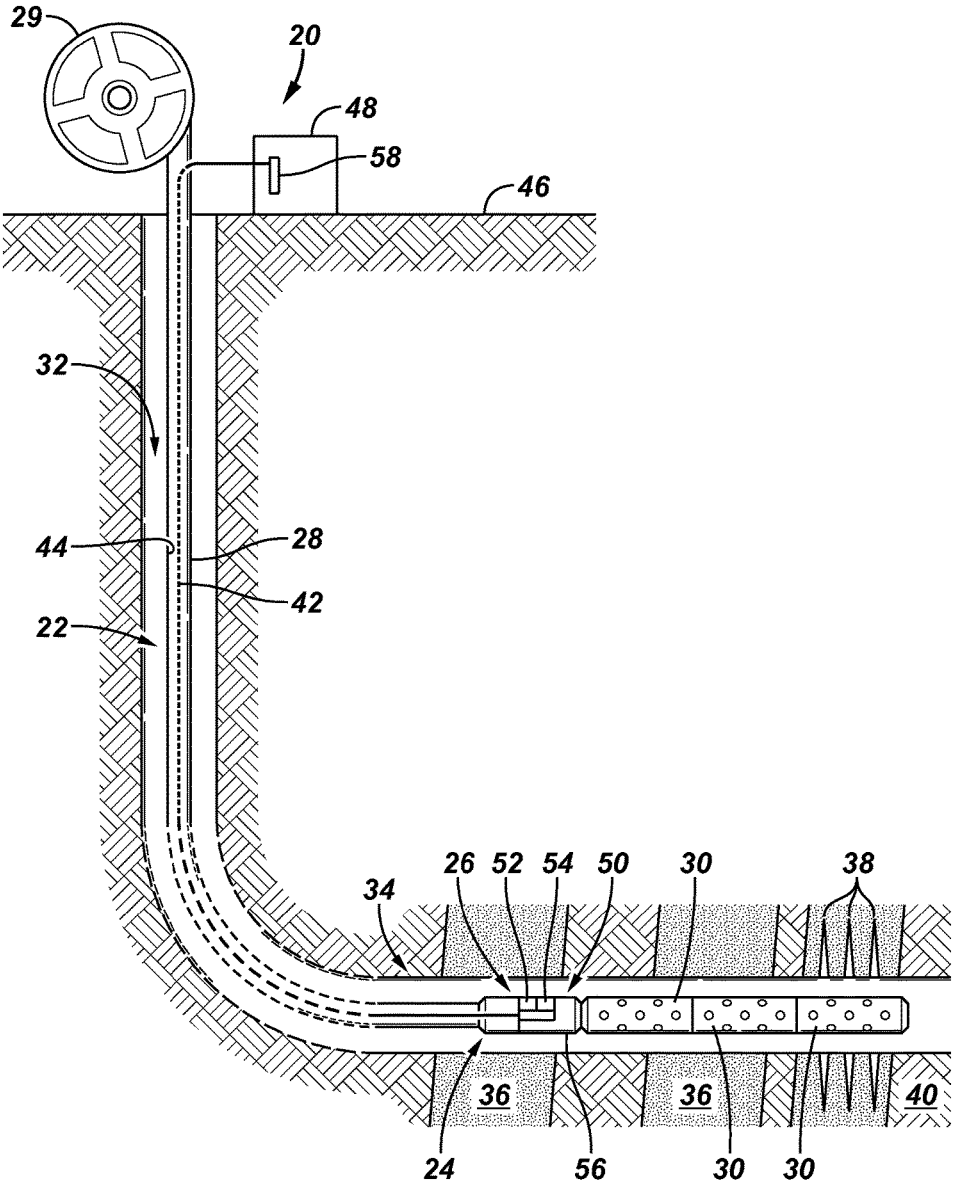
FIG. 1 is a schematic illustration of an example of a perforating system deployed downhole into a deviated wellbore, according to an embodiment of the disclosure.

Referring generally to FIG. 1, an embodiment of a perforation system 20 is illustrated. In this embodiment, perforation system 20 comprises a coiled tubing perforating assembly 22 having a bottom hole assembly 24 which includes a perforating gun assembly 26. The bottom hole assembly 24, including the perforating gun assembly 26, is connected to coiled tubing 28. The coiled tubing 28 may be coiled on appropriate coiled tubing surface equipment 29. Additionally, perforating gun assembly 26 comprises a plurality of individually controllable perforating gun sections 30 which may each be individually detonated and fired at a desired location along a wellbore 32. The perforating guns, e.g. gun sections 30, may be individually controlled such that adjacent gun sections 30 or non-adjacent gun sections 30 may be sequentially fired.

In the example illustrated, wellbore 32 has been drilled as a deviated wellbore having a deviated, e.g. horizontal, section 34. The deviated section 34 extends through a plurality of well zones 36 which may include non-contiguous well zones. The perforating gun assembly 26 is deployed downhole into the wellbore 32 to an initial well zone 36, e.g. the well zone 36 closest to the toe of the wellbore 32. Once at the desired well zone, the appropriate individually controllable perforating gun section 30 may be detonated and fired to create radially extending perforations 38 into the surrounding formation 40. Subsequently, the perforating gun assembly 26 may be moved via the coiled tubing 28 to the next desired well zone 36 and the detonation and firing process may be repeated via another individually controllable perforating gun section 30 to create perforations 38 at the next well zone 36. This process may be repeated until the desired well zones are perforated.

Referring again to FIG. 1, an optical fiber 42 is deployed along the coiled tubing 28 to provide control signals which are used to selectively initiate detonation and firing of the desired individually controllable perforating gun sections 30, as described in greater detail below. The optical fiber 42 may comprise an individual fiber or a plurality of fibers and may be in the form of, for example, a fiber optic tether disposed along the coiled tubing. The optical fiber 42 adds a very limited amount of weight to the overall coiled tubing perforating assembly 22, and the lightweight system facilitates greater reach into deviated and extended reach wellbores. As illustrated, the optical fiber 42 may be deployed along an interior 44 of coiled tubing 28 and is therefore deployed in a fluid flow path in the interior 44 of the coiled tubing 28. In many applications, the optical fiber 42 also may be used to relay data from the bottom hole assembly 24 to the surface 46. For example, real-time feedback may be transmitted uphole along optical fiber 42 regarding the perforating operation taking place downhole. The feedback also may be used to verify perforating operations via measurements taken from the perforating tool string and transmitted along optical fiber 42 from the perforating gun assembly 26 to the surface 46.

The optical fiber 42 may be coupled between surface equipment 48, such as a surface control system, and a downhole processor 50, such as a microprocessor. In some applications, the downhole processor 50 is constructed as a control system with a main processor 52 and a secondary processor 54. In the embodiment illustrated, the downhole processor 50 is located in a perforating head 56 of perforating gun assembly 26. By way of example, the surface control system 48 may utilize a dongle 58 or other suitable device to enable the surface control system 48 to send control signals to processor 50 via optical fiber 42 for testing and other purposes. The dongle 58 may be mated to the bottom hole assembly 24 such that the perforating gun assembly 26 may only fire to create the perforations 38 when the dongle 58 is in communication or otherwise present in the control system 48.

Figure 2:
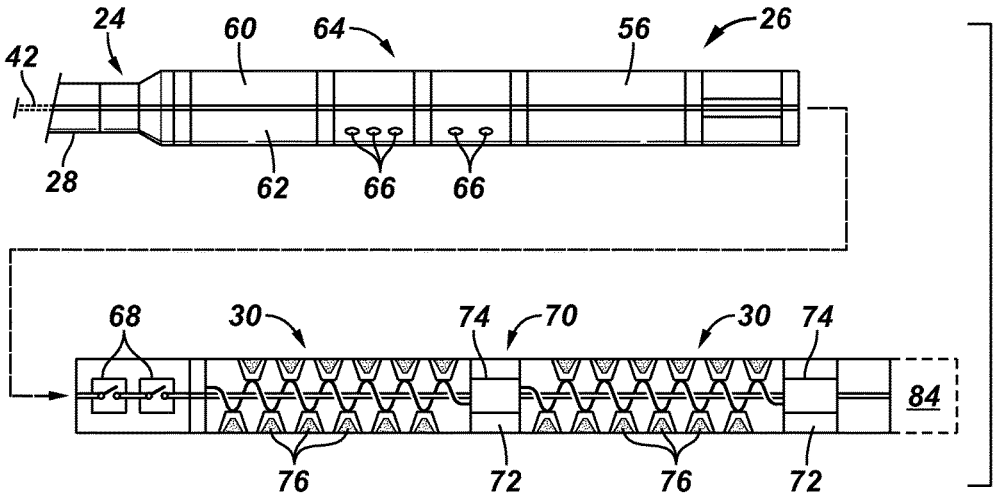
FIG. 2 is an illustration of an example of a bottom hole assembly including a perforating gun assembly having a plurality of individually controllable perforating gun sections, according to an embodiment of the disclosure.

Referring generally to FIG. 2, an example of bottom hole assembly 24 and perforating gun assembly 26 is illustrated, although the assembly may comprise additional or other components arranged in a variety of configurations. In the example illustrated, the perforating gun assembly 26 comprises a telemetry module 60 powered by suitable power source 62, such as a battery. The telemetry module 60 is coupled with optical fiber 42 and is powered to receive and/or send signals via optical fiber 42. In some applications, the telemetry module 60 may be incorporated into a pressure, temperature, and casing collar locator (PTC) sensor sub. Regardless of the specific structure, the telemetry module 60 may be connected to a sensor system 64, such as a measurement sensor sub, having a plurality of sensors 66. By way of example, sensors 66 may comprise pressure sensors, temperature sensors and depth correlation sensors, e.g. casing collar locators (CCLs) or gamma ray detectors. The depth correlation sensors 66 correlate the depth of the perforating gun assembly 26 and/or individual perforating gun sections 30 with a reference depth to enable adjustment for placement of the selected, individual perforating gun section 30 at the desired location in the zone 36 to be perforated.

The perforating gun assembly 26 further comprises perforating head 56 which is connected to individually controlled perforating gun sections 30 through a protection switch 68. In the example illustrated, the perforating head 56 is coupled to gun sections 30 through a plurality of protection switches 68. The perforating head 56 also may be coupled to the individually controllable perforating gun sections 30 via an addressable switch system 70 which may comprise a plurality of addressable switches 72. Examples of an addressable switch system 70 include the ASFS and Secure systems available from Schlumberger Wireline. System control is achieved using, for example, a computer of surface control system 48 to communicate with the downhole perforating gun assembly components through optical fiber 42 which may be deployed in the interior 44 coiled tubing 28. In the example illustrated, the addressable switches 72, in combination with perforating head 56, may be used to selectively detonate and fire individual perforating gun sections 30 via detonators 74. Each perforating gun section 30 may comprise a plurality of shaped charges 76 oriented to create perforations 38 at a desired well zone 36 upon detonation and firing.

Figure 3:
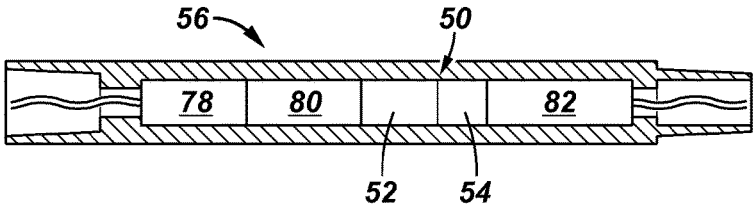
FIG. 3 is an illustration of an example of a perforating head for use in the perforating gun assembly, according to an embodiment of the disclosure.

The perforating head 56 may have a variety of components and configurations, however an example is illustrated in FIG. 3. In this example, the perforating head 56 comprises controller or processor 50 having main processor 52 and secondary processor 54. The perforating head 56 also comprises a power source 78, e.g. a battery pack, a capacitor bank 80, and an accelerometer 82 which may constitute one of the sensors 66. Protection switches 68 also may be part of perforating head 56 in some embodiments.

The processor 50, e.g. processors 52 and 54, may be programmed to perform multiple functions. For example, processor 50 may be designed to communicate with telemetry module 60 which, in turn, communicates uphole and/or downhole via optical fiber 42 to accept commands and to convey information uphole to surface control system 48. The processor 50 also may be designed to communicate in a downhole direction with the addressable switch system 70 and addressable switches 72 to enable firing of a specific perforating gun, e.g. a specific perforating gun section 30. In some applications, processor 50 also is employed to control the process of charging up the capacitors in capacitor bank 80. For example, the processor 50 may be designed to exercise control over the flow of electrical power from power source 78, e.g. a downhole battery, to the capacitor bank 80 and then to control release of energy from capacitor bank 80 to the selected perforating gun section 30.

In a variety of applications, processor 50 also may be employed to monitor selected tool parameters and to store desired data. Processor 50 may further be used to control and send data from sensors 66, e.g. accelerometer output, temperature, voltage, current, pressure, and/or other sensor data, uphole to surface control system 48 such as along the optical fiber 42. The sensor measurements may be conveyed in real time to provide details about the perforation operation, such as whether the desired perforating gun section has actually fired. If processor 50 comprises main processor 52 and secondary processor 54, the two processors may be used redundantly to confirm commands. For example, the processors may be programmed to agree that valid commands are sent before initiating detonation of perforating gun sections 30.

Although some embodiments may utilize power supplied from a surface location, many applications utilize power supplied from a downhole location to run the downhole electronics and to fire the perforating gun sections 30. Power sources 62 and 78 may comprise batteries or other suitable power sources used to supply the desired electric power. For example, power source 78 may comprise a battery coupled to capacitor bank 80 to charge the capacitors and to create a sufficiently high voltage to detonate the charges 76.

Processor 50 may be used to control the detonation by selectively activating the detonators 74. For example, following a command from surface control system 48, the processor 50 may be used to initiate boosting of the battery voltage to a desired perforating voltage level through appropriate electronic circuitry and via charge stored in capacitor bank 80. On demand from processor 50, the capacitor bank 80 is discharged and the appropriate addressable switch 72 is activated to enable supply of sufficiently high voltage to the desired detonator 74, thus causing detonation and firing of the gun section 30 associated with that particular detonator 74. In some embodiments, the capacitor bank 80 includes or cooperates with a voltage drain which bleeds off any undesirable voltage buildup in the capacitor bank 80.

In some applications, power may be supplied from the surface 46 using an appropriate conductor. For example, a conductor may be embedded in or otherwise packaged with the optical fiber 42. The level of voltage supplied from the surface in this type of configuration may be far lower than with a conventional setup using a wireline cable to transmit power. The special fiber optic tether comprising the internal conductor would be smaller in size and lighter in weight compared to a wireline cable, thus facilitating deployment of the perforating gun assembly 26 in deviated wellbores, such as the deviated section 34. In such an embodiment, voltage supplied from the surface would be used to charge the downhole capacitor bank 80 and the system would remain in a low voltage mode until initiation of the capacitor charging process.

In an embodiment, power to charge the capacitor bank 80 is generated downhole by a suitable power generation system. For example, power source 62 and/or power source 78 may be designed as a turbine positioned to extract energy from fluid flow pumped from the surface down through the interior 44 of coiled tubing 28. The power sources 62, 78 also may comprise a downhole photovoltaic cell designed to generate power downhole by converting light to electricity. In this example, laser light is supplied from the surface down through optical fiber 42 and the laser light is converted into electricity at one or both power sources 62, 78. This power may then be used to charge capacitor bank 80 and/or to provide power for other system components.

Depending on the specific application, a variety of detonators 74 may be employed. For example, Secure detonators available from Schlumberger Wireline may be employed. This latter type of system may utilize an exploding foil initiator (EFI) technology with no primary high explosives used in the detonator, as will be appreciated by those skilled in the art. The electronics may be contained in the detonator package and may be completely expendable so that no separate downhole cartridge is employed.

Additionally, various types of protection switches 68 may be employed. In some applications, protection switches 68 may be in the form of addressable arming protection switches which isolate the system and prevent stray voltages from energizing the perforating gun system accidentally. In some applications, the addressable arming protection switches 68 may be placed at a top of the gun string and the state of the switches may be processor controlled by, for example, processor 50. Similarly, a variety of addressable switch systems 70 and addressable switches 72 may be employed depending on the parameters of a specific application. The addressable switch firing system may be designed as a microprocessor controlled switch attached to each detonator 74 in the gun string/assembly 26 and controlled by processor 50. In this example, each addressable switch 72 has a unique address so that each gun section 30 is identified prior to firing. The system may be designed so that two way communication is a prerequisite to the detonation and firing of a given gun section 30, thus reducing the potential for inadvertent detonation. Additionally, bulkheads may be placed between gun sections 30 and may use one-wire feedthroughs which enable current flow for the detonation and firing of selected gun sections 30.

In some applications, the surface equipment 48, e.g. a computer-based surface control system, is equipped with a single point safety switch. This type of switch may be a single keylock safety switch having a properly secured single key which isolates the surface equipment prior to attachment of an explosive device, such as charges 76. In the embodiment described herein, the surface control system 48 comprises an electronic dongle 58 which prevents inadvertent sending of commands down through optical fiber 42, thus reducing or eliminating the risk of inadvertent detonation. During rig-up and assembly of the downhole components, electronic dongle 58 is disconnected to effectively prevent the downhole perforating gun assembly 26 from firing, similar to the way that a perforating key is removed from a conventional perforating surface control system. The surface control system 48 becomes active when the electronic dongle 58 is connected but not until the gun string assembly 26 and its associated components are a predetermined distance downhole, e.g. 200 feet into the well. Similarly, the electronic dongle 58 may be disabled during retrieval when the bottom hole assembly 24 is at a predetermined depth downhole, thus disabling the surface control system 48. Additionally, a timeout feature in the communication link between the surface control system 48 and the downhole processor 50 may be used to mitigate the potential for failing to manually disable the communication link between the system 48 and the downhole processor 50.

In some embodiments, the perforating gun assembly 26 is designed to provide shot firing event confirmation. Depending on the construction of the perforating gun assembly 26, the addressable switch 72 associated with a given controllable gun section 30 may be destroyed when the gun section 30 is fired. The inability to communicate with the processor 50 may be used as an indication of firing. In addition, however, the indication may be augmented due to the occurrence of a shock load upon firing and the sensing of this shock load by suitable sensors 66 located in the perforating gun assembly. Accelerometer 82 also may be used as a suitable sensor 66 to detect the shock load. The lack of communication from the addressable switch 72 and the sensing of the shock load by a suitable sensor, e.g. accelerometer 82, provide a positive confirmation of downhole detonation. However, other sensors also may be used to confirm or to augment confirmation of firing. For example, downhole pressure sensors 66 and/or downhole temperature sensors 66 also may be used to confirm a successful perforation operation at a given well zone 36. In some applications, fluid channels extending into the reservoir/formation due to the perforation operation enable an influx of fluids into the wellbore. The inflow of fluids creates a change in pressure and/or temperature conditions downhole which may be detected by suitable sensors 66 as an indication of a successful perforation operation.

During a perforating application, bottom hole assembly components are assembled at the surface as illustrated in, for example, FIG. 2. Prior to connection of the individually controllable perforating gun sections 30, a surface function test may be performed on the system. In some applications, the surface function test is performed with a tester module 84 connected to the perforating gun assembly 26, e.g. to the bottom of the perforating gun assembly 26. The tester module 84 may be formed as a separate module; incorporated into the processor module 50; or combined with another suitable component of the perforating gun assembly 26. During the surface function testing, a "pairing" of the electronic dongle 58 of surface control system 48 and the downhole electronic tester module 84 is performed. The test pairing ensures that the downhole tester module 84 responds to commands validated through the electronic dongle 58.

The module 84 also may be designed as an addressable switch gun simulator able to mimic the presence of addressable switches 72 connected to the perforating head 56. By simulating a series of switches, the software and hardware of the system may be checked without involving explosives. Once pairing has been completed, the surface test also may involve tearing out a comprehensive system function check of the entire process cycle for perforating. According to an embodiment, the system function check may comprise establishing communication with the individual addressable switches 72, initiating the charging of the capacitor bank 80 to the appropriate voltage level, and applying voltage to a selected detonator to simulate firing of a gun section 30. Successful completion of the procedure provides an indication that the system is functioning properly.

Other equipment also may be used during the surface test procedure. For example, an addressable switch tester and a personal data assistant controller may be employed to further facilitate testing of the addressable switch system 70 prior to deployment of the perforating gun assembly 26 downhole into wellbore 32 but after the perforating gun assembly has been assembled. Such testing may be performed prior to operatively connecting the perforating head 56.

The perforation system 20 provides an improved, coiled tubing-based system for selectively perforating desired zones of wells, such as oil and gas wells. Selective perforating implies performing multiple detonations during a single run downhole. However, the system also may be employed for single fire perforation applications.

Figure 4:
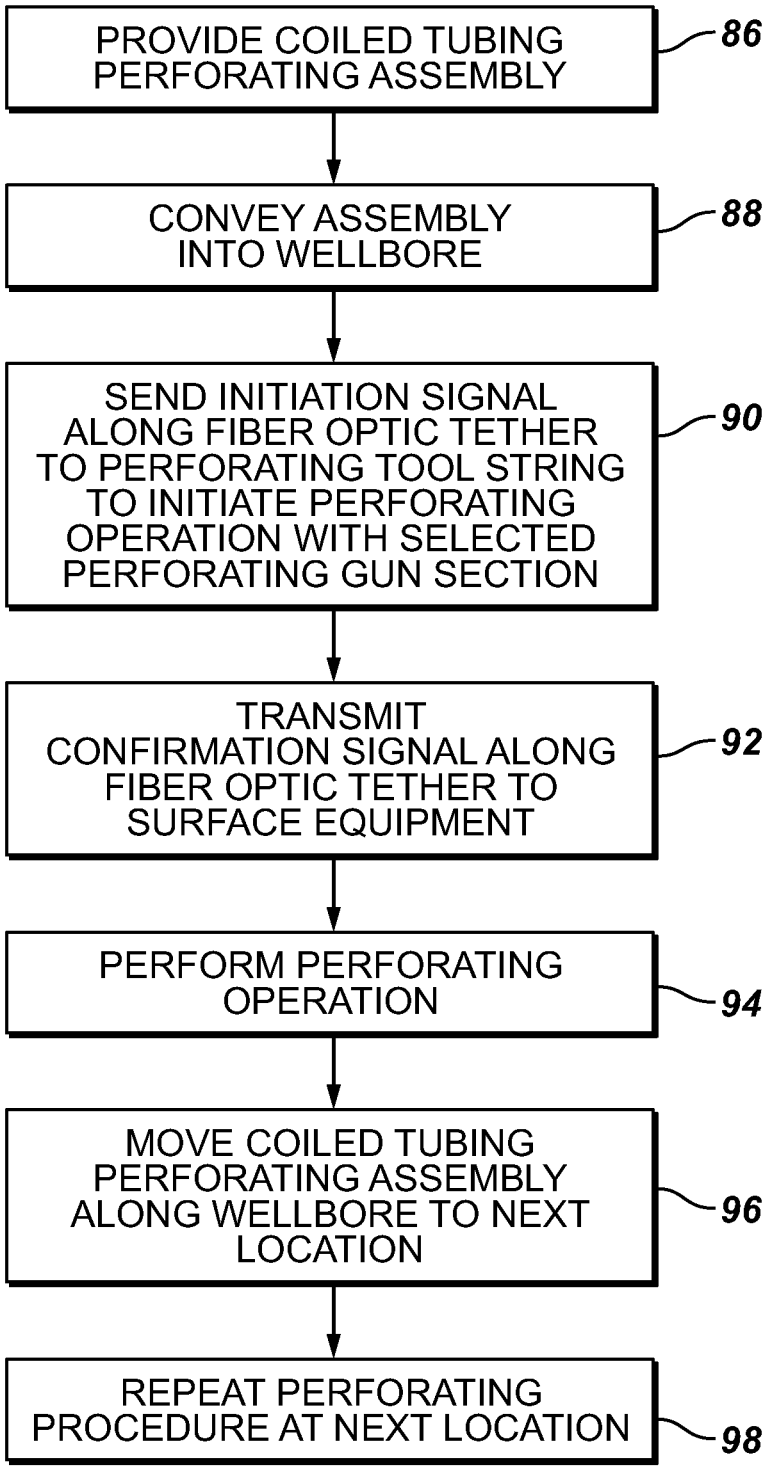
FIG. 4 is a flowchart illustrating an example of a perforating operation, according to an embodiment of the disclosure.

Referring generally to the flowchart of FIG. 4, an example of a perforating application is illustrated. In this example, the perforating gun assembly 26 is assembled and coupled with coiled tubing 28 and optical fiber 42, as indicated by block 86. The perforating gun assembly 26 is then conveyed downhole into wellbore 32 and moved along deviated section 34, as indicated by block 88. An initiation signal is then sent downhole from surface control system 48 along optical fiber 42 to the perforating tool string, e.g. perforating gun assembly 26, to initiate a perforating operation with a selected perforating gun section 30, as indicated by block 90. The processor 50 may then be used to transmit a confirmation signal uphole along optical fiber 42 to surface control system 48 to confirm receipt of the initiation signal, as indicated by block 92. The perforating operation is then performed at a given well zone 36 by firing the appropriate gun section 30, as indicated by block 94. Upon completion of the perforation operation, the coiled tubing 28 is moved which, in turn, moves the perforating gun assembly to the next perforation location, as indicated by block 96. The perforation procedure is then repeated at this next location and at each subsequent location until the overall perforation operation is completed, as indicated by block 98.

Figure 5:
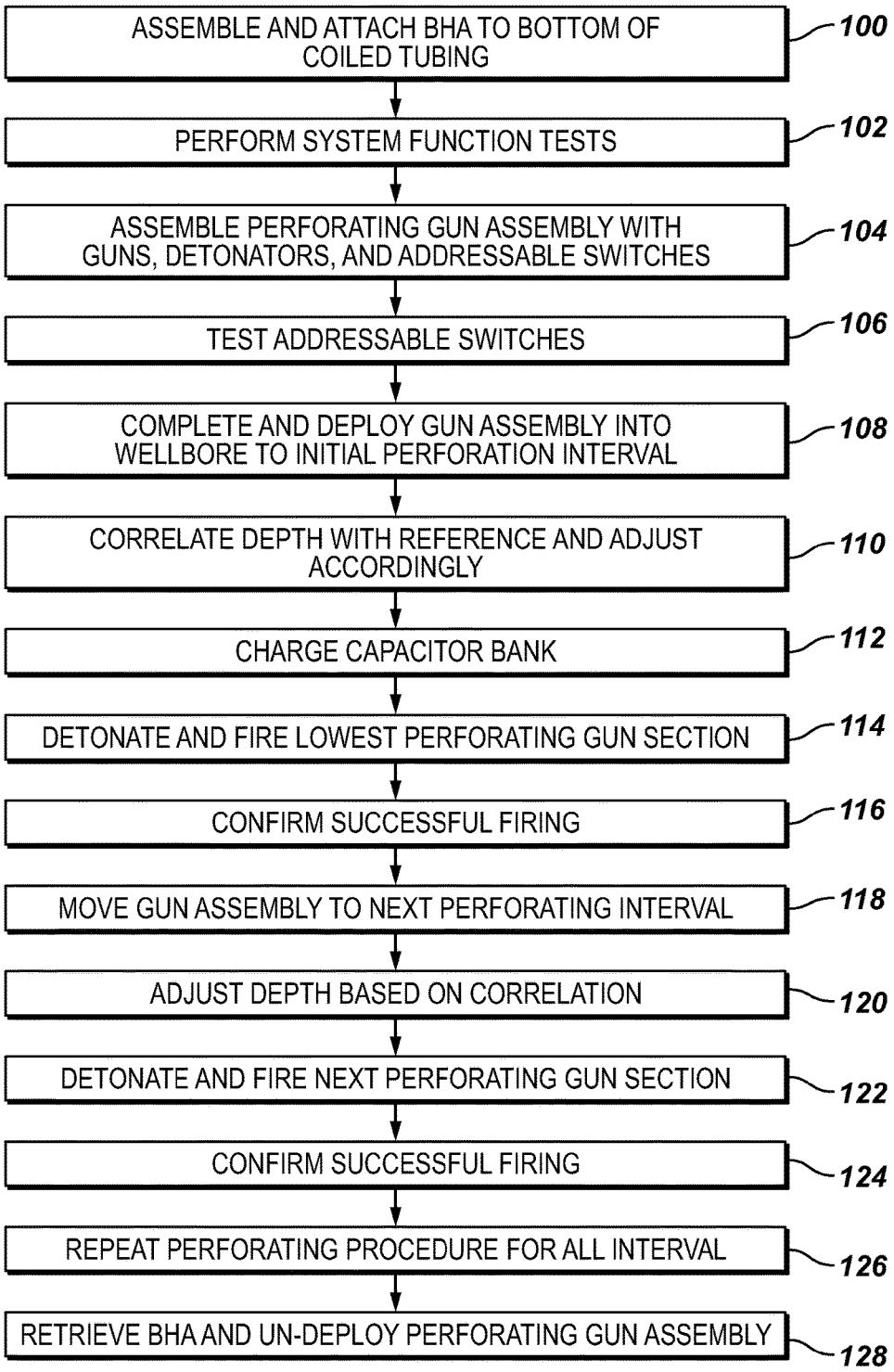
FIG. 5 is a flowchart illustrating another example of a perforating operation, according to an embodiment of the disclosure.

Another procedural example is illustrated in the flowchart of FIG. 5. In this example, the bottom hole assembly (BHA) 24 is assembled and attached to a bottom end of coiled tubing 28, as indicated by block 100. In some embodiments, this initial assembly of bottom hole assembly 24 does not include attaching the perforating gun sections 30. Once attached to coiled tubing 28, system function tests may be performed using, for example, testing module 84, as indicated by block 102. After successful testing, the remainder of the perforating gun assembly 26 may be assembled and combined into the bottom hole assembly 24. For example, the gun sections 30, detonators 74, and addressable switches 72 may be assembled, as indicated by block 104. The addressable switches 72 are then tested with, for example, an addressable switch tester as discussed above and as indicated by block 106.

Following testing, makeup of the bottom hole assembly 24 is completed and the perforating gun assembly 26 is deployed into wellbore 32 to an initial perforation interval, as indicated by block 108. In many applications, the perforation sequence involves detonation at a lower or distant well zone 36 with subsequent detonations and perforation procedures being performed along the wellbore 32 moving the bottom hole assembly 24 in a direction toward surface 46. Once at the initial perforation interval, the depth of the appropriate gun section 30 is correlated with a reference so that appropriate adjustments may be made, as indicated by block 110.

A control signal may then be sent from surface control system 48 to processor 50, and processor 50 controls the charging of capacitor bank 80, as indicated by block 112. Electric power from the capacitors in the capacitor bank 80 may then be used to detonate and fire the selected, e.g. lowest, perforating gun section 30 by sending the appropriate signal to the corresponding addressable switch 72, as indicated by block 114. Successful firing of the gun section 30 is then confirmed by, for example, suitable sensor 66, as described above and as indicated by block 116. In some embodiments, the addressable switches 72 may be employed in both receiving and sending initiation and confirmation signals, respectively.

After the initial perforations 38 are formed at the desired well zone 36, the perforating gun assembly 26 is moved via coiled tubing 28 to the next perforating interval, as indicated by block 118. The depth of the next sequential gun section 30 is then adjusted and correlated with a reference, as indicated by block 120. After adjusting the gun section 30 to the desired depth, the appropriate gun section 30 is detonated and fired to create perforations 38 in the subsequent well zone 36, as indicated by block 122. The successful firing is again confirmed, as indicated by block 124. This movement, placement, firing, and confirmation process is repeated for each of the intervals to be perforated, as indicated by block 126. Once the desired intervals are perforated, the bottom hole assembly 24 is pulled back to the surface and the perforating gun sections are un-deployed from the well, as indicated by block 128. At this stage, the bottom hole assembly 24 may be disassembled or otherwise processed for a subsequent perforating operation.

During the perforating procedure, the capacitor bank 80 may be charged back up should the voltage drop below the predetermined voltage used for detonation. Additionally, various other processes may be combined with or used in place of portions of the procedures described above. For example, the activation/de-activation of the protection switches 68, electronic dongle 58, testing module 84, and/or other components may be performed prior to and/or during the overall perforation procedure.

In many oil and gas well applications, the perforation techniques described herein may be employed to provide a selective, reliable and repeatable firing of perforating guns to provide perforations at various locations along a wellbore.

By using optical fiber 42 and fiber optic-based telemetry, the weight of the overall coiled tubing system is reduced. The lighter weight system is particularly helpful in long, extended reach wells, where additional weight may result in compromises with respect to depth penetration capability.

The perforation system 20 also may be powered from downhole locations by, for example, batteries or other power sources. Such systems may utilize relatively low voltages with virtually no elevated voltages present at the surface. The higher voltage for detonation is selectively created downhole by controlled charging of the capacitor bank 80. Except for the possible, short duration surface system test, the voltages of the capacitor bank 80 are held at a low level until the perforating operation is ready to be performed downhole. Various protection switches and other devices also may be employed to provide high system dependability and fail-safe functionality. Additionally, the downhole processor, e.g. microprocessor, further ensures a high level of reliability. The redundancy of a second processor 54 also may be used to provide an additional stop-gap that ensures very dependable functioning of the overall perforation system.

As described herein, the systems, devices and procedures used to perform perforating operations may have a variety of configurations and may be designed for use in a variety of environments. For example, the number and arrangement of perforating gun sections may vary depending on the well zones to be perforated. Additionally, the surface control systems and downhole control systems may utilize a variety of microprocessors or other types of processors for sending and/or receiving signals. The fiber optic telemetry system may utilize individual fibers, multiple fibers, combinations of fibers and conductors, various fiber optic tethers, and other types of optical fiber communication lines. Several types of equipment also may be employed for transmitting and receiving the optical signals. The arrangement of perforating gun assembly components, bottom hole assembly components, coiled tubing components, and other components of the overall perforation system may be modified, interchanged, and/or supplemented according to the parameters of a given perforation operation and environment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for performing a perforation operation in a wellbore, comprising:

positioning a perforating gun assembly, having a plurality of individually controllable perforating gun sections, downhole in the wellbore via coiled tubing;

utilizing optical fiber deployed along the coiled tubing to deliver control signals to the perforating gun assembly from a control system at a surface of the wellbore, the control system comprising a dongle; and using the control signals to sequentially fire the individually controllable perforating gun sections at desired locations along the wellbore, wherein sequentially firing is enabled only when dongle is in communication with the control system and the perforating gun assembly.

2. The method as recited in claim 1, wherein utilizing comprises utilizing the optical fiber while positioned in an interior of the coiled tubing.

3. The method as recited in claim 1, wherein utilizing comprises utilizing the optical fiber to deliver control signals from a surface control system to a downhole processor.

4. The method as recited in claim 3, further comprising coupling the downhole processor to an addressable switch detonation system used to selectively fire the individually controllable perforating gun sections.

5. The method as recited in claim 1, further comprising providing the perforating gun assembly with a sensor system; and relaying data from the sensor system to the surface via the optical fiber.

6. The method as recited in claim 1, further comprising providing electric power for detonation of the individually controllable perforating gun sections from a downhole location.

7. The method as recited in claim 6, wherein providing electric power comprises utilizing a battery and a capacitor bank located in the perforating gun assembly.

8. The method as recited in claim 1, further comprising providing the perforating gun assembly with a perforating head having a controlled microprocessor with a main processor and a secondary processor to redundantly confirm control signals received via the optical fiber.

9. The method as recited in claim 1, further comprising providing the perforating gun assembly with a perforating head having a battery pack, a capacitor bank, an accelerometer, and at least one protection switch.

10. A method for performing a perforation operation within a wellbore, comprising:

providing a coiled tubing perforating assembly for use in the wellbore, the coiled tubing assembly comprising:

a length of coiled tubing coiled on surface equipment at a surface of the wellbore, a perforating tool string disposed on an end of the coiled tubing, the perforating tool string comprising a plurality of perforating guns, a fiber optic tether disposed within the coiled tubing and providing a communication link between surface control equipment and the perforating tool string; and a dongle device attached to the surface equipment for enabling the surface equipment to send command signals to the perforating tool string;

disposing the coiled tubing perforating assembly into the wellbore;

sending an initiation signal along the fiber optic tether from the surface control equipment to the perforating tool string to initiate a first perforating operation utilizing at least one selected perforating gun, wherein the dongle device enables the initiation signal when in communication with the control system;

sending a confirmation signal along the fiber optic tether from the perforating tool string to the surface equipment;

performing the perforating operation with the at least one selected perforating gun and/or guns after receiving the confirmation signal;

moving the coiled tubing perforating assembly to another location in the wellbore; and repeating sending the initiation signals, sending the confirmation signals, and performing another perforating operation with another of the perforating guns.

11. The method as recited in claim 10, further comprising providing the perforating tool string with at least one addressable switch for use in receiving and sending the initiation and confirmation signals.

12. The method as recited in claim 10, further comprising test pairing the dongle device with the perforating tool string prior to disposing to ensure the perforating tool string responds only to commands signals validated by the dongle device.

13. The method as recited in claim 10, further comprising verifying the perforating operations via measurements taken from the tool string and transmitting the measurements along the fiber optic tether from the perforating tool string to the surface control equipment.

14. The method as recited in claim 10, further comprising acquiring data during the perforating operation and transmitting the acquired data to the surface control equipment along the fiber optic tether.

15. The method as recited in claim 14, wherein transmitting the acquired data comprises providing real-time feedback on the perforating operation.

16. The method as recited in claim 10, further comprising testing the perforating tool string prior to disposing the coiled tubing perforating assembly into the wellbore.

17. The method as recited in claim 10, wherein performing the perforating operation with the at least one selected perforating gun comprises performing the operation with at least two guns that are not adjacent to each other along the perforating tool string.

18. The method as recited in claim 10, wherein disposing the coiled tubing perforating assembly into the wellbore comprises disposing the coiled tubing perforating assembly into a deviated wellbore.

19. A system for perforating a wellbore, comprising:

a perforating gun assembly having at least one perforating head, a plurality of individually controllable perforating gun sections, and a processor positioned to control the detonation of the individually controllable perforating gun sections;

coiled tubing coupled to the perforating gun assembly to move the perforating gun assembly along the wellbore; and at least one optical fiber positioned along the coiled tubing to deliver control signals to the processor from a surface-based control system, the surface-based control system comprising a dongle that prevents inadvertent control signals from being passed from the control system to the perforating gun assembly.

20. The system as recited in claim 19, wherein the at least one perforating head comprises the processor along with a battery pack, a capacitor bank, an accelerometer, and at least one protection switch.

* * * * *